United States Patent [19]

Sargentini

[11] Patent Number: 4,601,070

[45] Date of Patent: Jul. 22, 1986

[54] NOVELTY SKI HAT

[76] Inventor: Constantine Sargentini, 11 E. June St., Lindenhurst, N.Y. 11757

[21] Appl. No.: 745,868

[22] Filed: Jun. 17, 1985

[51] Int. Cl.[4] ..... A42B 1/06

[52] U.S. Cl. ..... 2/209; 2/185 R; 2/422; D21/59; 272/8 N

[58] Field of Search ..... 2/209.1, 185 R, 171.2, 2/199, 422; D2/263, 260, 261; D21/59; 272/8 N; 446/27

[56] References Cited

U.S. PATENT DOCUMENTS

| | | | |
|---|---|---|---|
| 1,283,686 | 11/1918 | Dahl | 2/185 R |
| 1,502,108 | 7/1924 | McWilliam | 2/185 R |
| 1,776,175 | 9/1930 | Wittekind | 2/185 R |
| 2,616,091 | 11/1952 | Luttge | 2/209.3 |
| 3,216,149 | 11/1965 | Briese | 2/185 R |
| 3,229,872 | 1/1966 | Williams | 446/27 |
| 4,148,199 | 4/1979 | Boykin | 272/8 N |
| 4,488,372 | 12/1984 | Lowen | 446/27 |

FOREIGN PATENT DOCUMENTS

| | | | |
|---|---|---|---|
| 45362 | 7/1935 | France | 2/185 |

OTHER PUBLICATIONS

Novelle Mode, "Gifts and Decorative Accessories", Jul. 1984, p. 35, D2159.

Play Things, Mar. 1959, p. 86, Tippett & Wood Phillipsburg, N.J.

*Primary Examiner*—Werner H. Schroeder

*Assistant Examiner*—Mary A. Ellis

*Attorney, Agent, or Firm*—Richard L. Miller

[57] ABSTRACT

This invention is a novelty ski cap that includes a novelty ski pole pierced horizontally through a cap and including an upwardly bent central portion fitting between an underside of the cap and a top of the wearer's head.

2 Claims, 1 Drawing Figure

NOVELTY SKI HAT

BACKGROUND OF THE INVENTION

This invention relates generally to skiing equipment and accessories. More specifically it relates to novelty ski caps and headgear.

Once in a while a new novelty appears upon the market that attracts wide appeal of the buying public so that it becomes a fad. Novelty caps have always been among such articles, as for example the beane cap with a spinning propeller on its top, or the cap with large mouse ears. In time the fad wears out and the public is ready for a next one that attracts it for purchase.

SUMMARY OF THE INVENTION

Accordingly it is a principal object of the present invention to provide a novelty hat that is certain to particularly appeal to youths and children, whether they ski or not, by producing amazement and wonder of how an individual can live with a ski pole apparently going through a center of his head.

Another object is to provide a novelty ski hat which accordingly is funny in appearance and is fun to wear and see its effect on other observers.

Yet another object is to provide a novelty ski hat having a propeller that can be made to rotate in a wind such as when either skiing, running, skating or bicycling.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENTS

Figure 1:
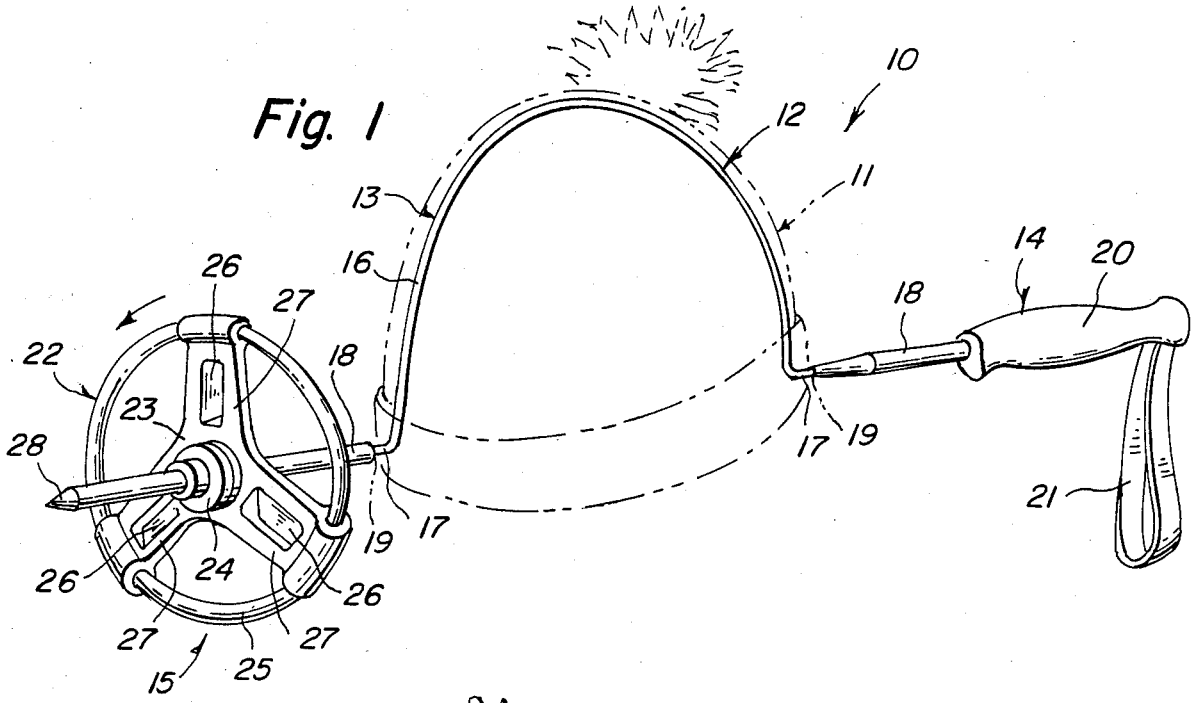
FIG. 1 is a perspective view of the invention.
Figure 2:
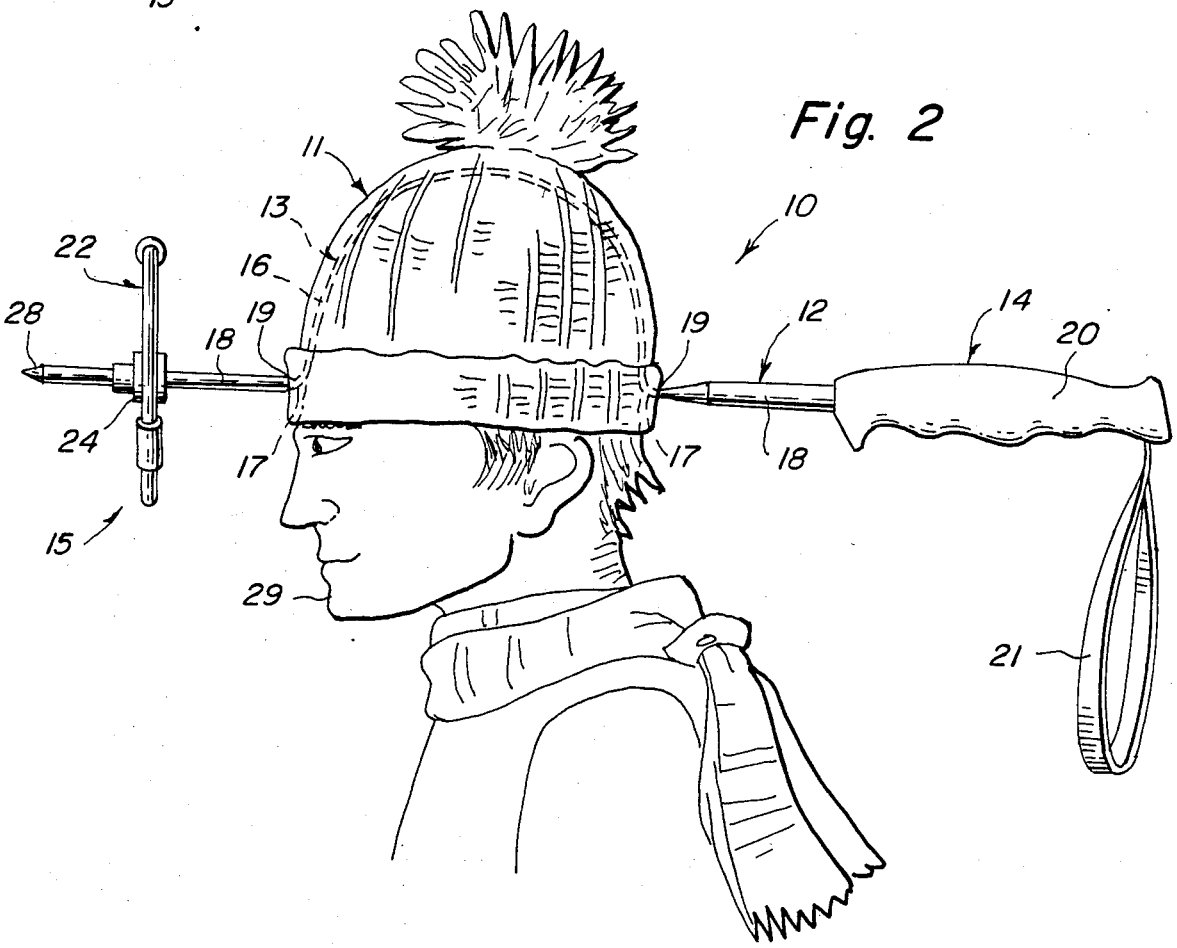
FIG. 2 is a side elevational view thereof shown being worn by a person.

Referring now to the Drawing in greater detail, the reference numeral 10 represents a novelty ski hat, according to the present invention, wherein there is a conventional ski cap or hat 11 and a novelty ski pole 12 which extends through the cap.

The cap preferably is made of a woven fabric such as is used in cap manufactures. Alternately it can, of course, be made of any other suitable material that will appeal to any particular market other than skiers.

The novelty ski pole comprises a bent rod 13 having a conventional appearing ski pole handle unit 14 on its rear end and a conventional appearing ski pole prong unit 15 on its front end. The rod may be made either of metal wire or molded plastic, and includes a semi-circular central portion 16 for extending across a top of an individual's head, and a straight end portion 17 at each end which axially align with one another. The handle unit and prong unit each include a shaft 18 that resembles a portion of a conventional ski pole shaft. One of these may be permanently attached to one of the rod end portions, while the other may be removably attached to the other rod end portion, such as by cement, screw thread, or the like, thus permitting the rod to be threaded through a hole 19 at a front and rear end of the cap before the ski pole unit is fully assembled. This also permits the ski pole unit to be attached to another cap instead, if wished. A handle 20 and thong 21 is affixed on an end of one of the shafts 18 while a propeller 22 is mounted rotatively along the other shaft 18; the propeller resembling the appearance of a pad of a conventional ski pole by including a web member 23 between a central hub 24 and an outer ring 25, which in the present invention may be molded of a one piece plastic. The web includes a wind vane blade 26 formed on each spoke 27 of the web, and a tip 28 of the shaft is pointed such as on a real ski pole.

In use, the novelty ski hat is worn by a user 29 by the cap fitting on his head and the rod portion 16 being between an underside of the cap and the top of the head so as to be hidden from view, while the units align through the wearer's forehead.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A novelty ski hat, comprising in combination, a cap and a novelty ski pole extending through said cap, said novelty ski pole extending in a horizontal direction through said cap with a prong unit thereof in front of said cap, and a handle unit thereof at a rear of said cap and propeller means being provided on said novelty ski pole, means for removably connecting one of said units from the ski pole to permit removal of the ski pole from the cap for placement onto another cap, said ski pole including means to pass between an underside of cap and underside of a wearer's head, while said units are aligned through a forehead of said wearer.

2. The combination as set forth in claim 1, wherein said ski pole includes means to pass between an underside of said cap and an upper side of a wearer's head, while said units are aligned through a forehead of said wearer.

* * * * *